US005304085A

United States Patent [19]

Novak

[11] Patent Number: 5,304,085

[45] Date of Patent: Apr. 19, 1994

[54] TOY BUBBLE KIT

[76] Inventor: Patricia M. Novak, 9406 Fullerdale Ave., Baltimore, Md. 21234

[21] Appl. No.: 993,374

[22] Filed: Dec. 18, 1992

[51] Int. Cl.[5] ..... A63H 33/28

[52] U.S. Cl. ..... 446/15; 401/122

[58] Field of Search ..... 446/15-21; 220/278, 373, 709; 401/122, 446

[56] References Cited

U.S. PATENT DOCUMENTS

| | | | |
|---|---|---|---|
| 2,858,639 | 11/1958 | Lawrence | 446/16 |
| 3,579,898 | 5/1971 | Hein | 446/16 |
| 3,583,018 | 6/1971 | Fink | 401/122 X |
| 3,950,887 | 4/1976 | Kort | 446/15 |
| 4,948,009 | 8/1990 | Sawatani | 220/709 X |

*Primary Examiner*—Mickey Yu

*Attorney, Agent, or Firm*—Leon Gilden

[57] ABSTRACT

A kit to include a container and a bubble distribution member is provided to include the dispenser having a lid, with the lid including a top wall, the top wall having a slot. The slot has cooperative resilient flaps engaging one another preventing spillage from within the container. The bubble distribution member includes a plurality of interchangeable loops arranged for reception through the slot and into a soap solution for subsequent waving of the distribution member for distribution of bubbles therefrom.

3 Claims, 4 Drawing Sheets

TOY BUBBLE KIT

BACKGROUND OF THE INVENTION

1. Field of the Invention

The field of invention relates to toy bubble distribution structure, and more particularly pertains to a new and improved toy bubble kit wherein the same is arranged to provide for a spill proof container in association with a bubble dispensing structure.

2. Description of the Prior Art

The use of conventional bubble soap as is commercially available includes the positioning of various loops within the bubble soap and subsequently either waving or directing air into one of the loops for projection of bubbles therefrom. In the use of conventional kit structure, the container is subject to spillage, wherein the instant invention overcomes deficiencies of the prior art by providing for a convenient and readily employed container for access by children and the like. The prior art has heretofore provided for various spill proof containers as indicated in U.S. Pat. Nos. 3,781,164; 4,986,437; 4,045,273; 5,044,531; and 4,714,174.

The instant invention attempts to overcome deficiencies of the prior art by providing for a convenient and effective organization of limited components to effect a non-spill container in association with a bubble distribution member and in this respect, the present invention substantially fulfills this need.

SUMMARY OF THE INVENTION

In view of the foregoing disadvantages inherent in the known types of bubble distribution structure now present in the prior art, the present invention provides a toy bubble kit wherein the same is arranged to provide for a bubble distribution wand in association with a spill proof container. As such, the general purpose of the present invention, which will be described subsequently in greater detail, is to provide a new and improved toy bubble kit which has all the advantages of the prior art bubble forming apparatus and none of the disadvantages.

To attain this, the present invention provides a kit to include a container and a bubble distribution member, to include the dispenser having a lid, with the lid including a top wall, the top wall having a slot. The slot has cooperative resilient flaps engaging one another preventing spillage from within the container. The bubble distribution member includes a plurality of loops arranged for reception through the slot and into a soap solution for subsequent waving of the distribution member for distribution of bubbles therefrom.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy bubble kit which has all the advantages of the prior art bubble forming apparatus and none of the disadvantages.

It is another object of the present invention to provide a new and improved toy bubble kit which may be easily and efficiently manufactured and marketed.

It is a further object of the present invention to provide a new and improved toy bubble kit which is of a durable and reliable construction.

An even further object of the present invention is to provide a new and improved toy bubble kit which is susceptible of a low cost of manufacture with regard to both materials and labor, and which accordingly is then susceptible of low prices of sale to the consuming public, thereby making such toy bubble kits economically available to the buying public.

Still yet another object of the present invention is to provide a new and improved toy bubble kit which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
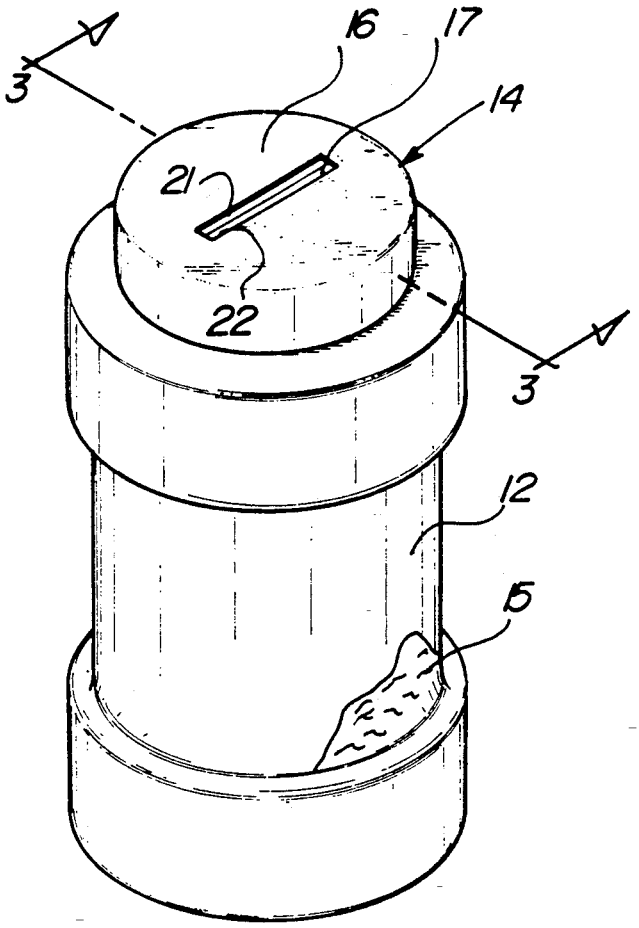
FIG. 1 is an isometric illustration of the container of the invention.

With reference now to the drawings, and in particular to FIGS. 1 to 8 thereof, a new and improved toy bubble kit embodying the principles and concepts of the present invention and generally designated by the reference numerals 11–44 will be described.

Figure 2:
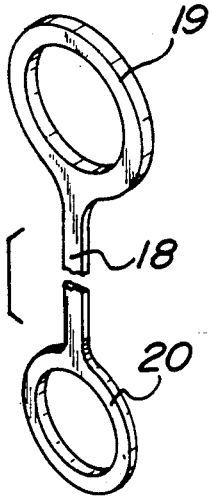
FIG. 2 is an isometric illustration of a bubble distribution member employed by the invention.

More specifically, the toy bubble kit of the instant invention essentially comprises a container 11 having a side wall 12, with a container lid 14 arranged for mounting to an upper end of the side wall 12 to contain a "bubble soap" 15 therewithin. This fluid 15 is of a type commercially available for producing a film within various bubble distribution member loops for subsequent projection from the loops to form bubbles for amusement of children and the like. The lid having a lid top wall 16, includes a lid top wall slot 17 therethrough of a predetermined length. The bubble distribution member, as indicated in FIG. 2 for example, includes a handle plate 18 having a first loop 19 of a first diameter less than the predetermined length, with a second loop 20 at a second end of the handle plate 18 of a second diameter less than the first diameter to provide for forming of bubbles of various diameters relative to the first and second loops 19 and 20 formed at first and second ends of the handle plate 18. The first loop 19, the second loop 20, and the handle plate 18 are in substantially coplanar orientation relative to one another.

Figure 3:
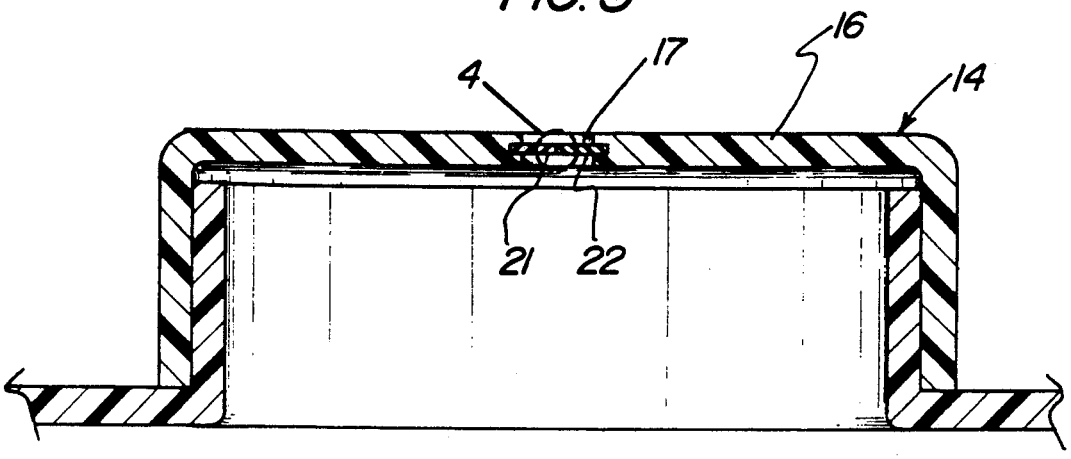
FIG. 3 is an orthographic view, taken along the lines 3—3 of FIG. 1 in the direction indicated by the arrows.
Figure 4:
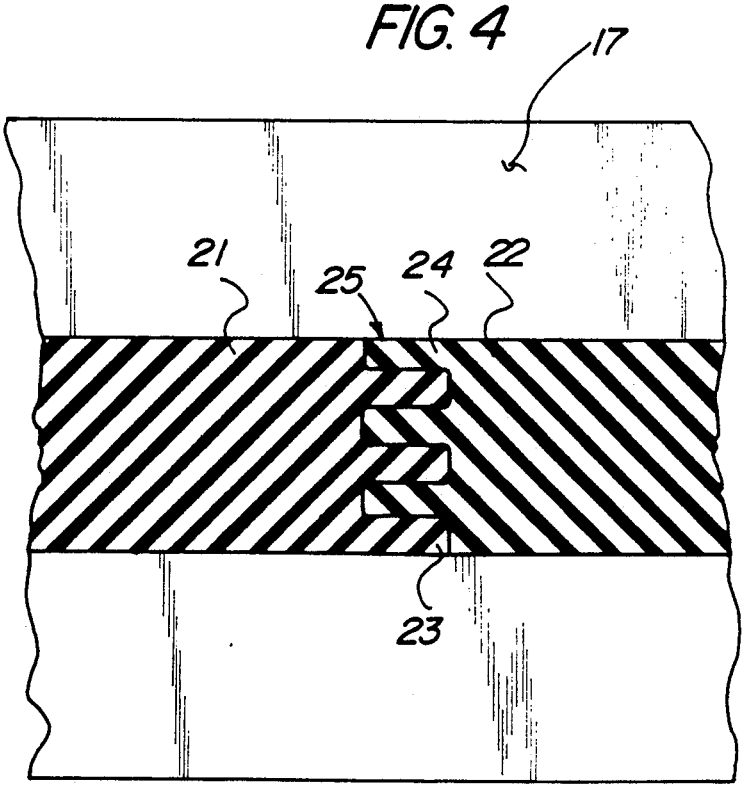
FIG. 4 is an enlarged orthographic view of section 4 as set forth in FIG. 3.

The top wall slot 17, as indicated in the FIGS. 1, 3, and 4, includes cooperative first and second resilient flaps 21 and 22 joined together at interdigited interface 25. The first flap 21 includes a plurality of first digits 23, with a second flap 22 having a plurality of second digits 24 that are arranged for the interdigited communication relative to one another, as indicated in FIG. 4, coextensive of the slot 17, whereupon removal of the bubble distribution member from within the slot subsequent to positioning a bubble soap thereon, the flaps will close securing the fluid therewithin.

Figure 5:
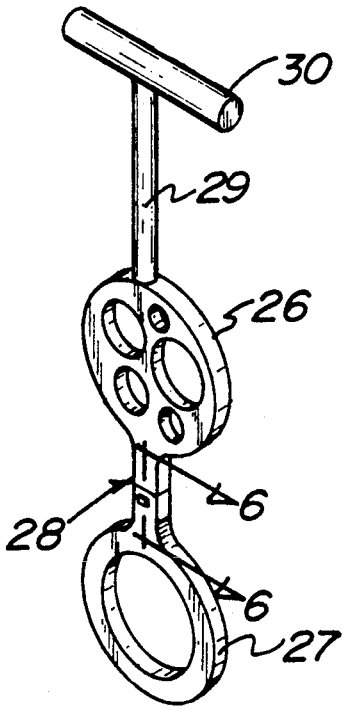
FIG. 5 is an isometric illustration of a modified bubble distribution member.
Figure 6:
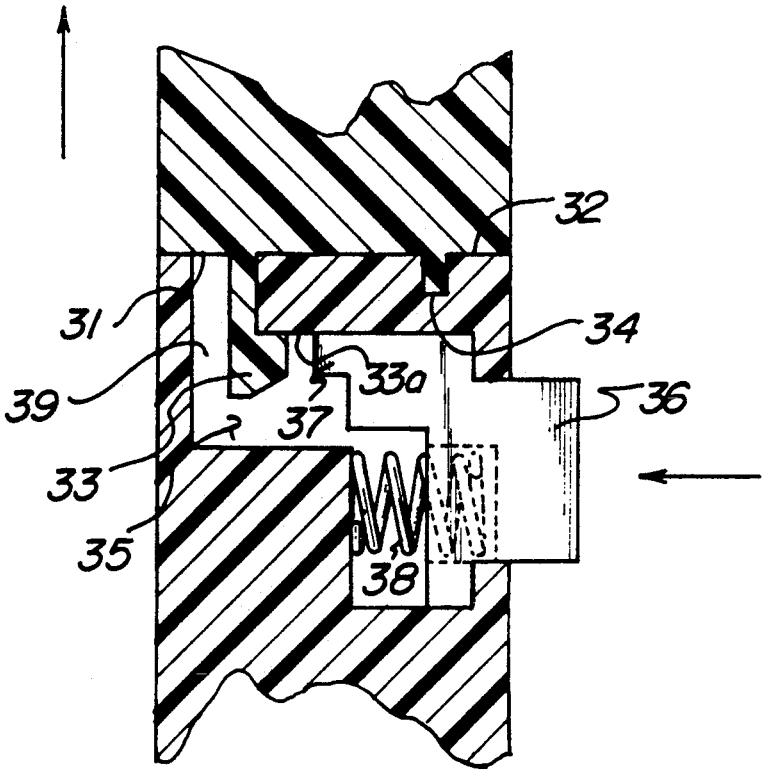
FIG. 6 is an orthographic view, taken along the lines 6—6 of FIG. 5 in the direction indicated by the arrows.
Figure 7:
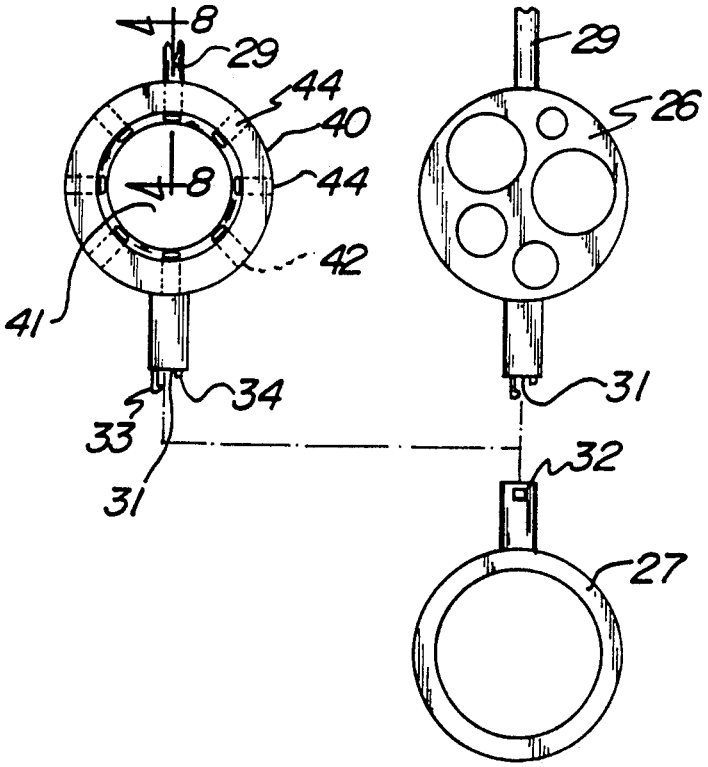
FIG. 7 is an isometric illustration of the modified toy bubble distribution member employing a plurality of bubble distribution loops thereto.
Figure 8:
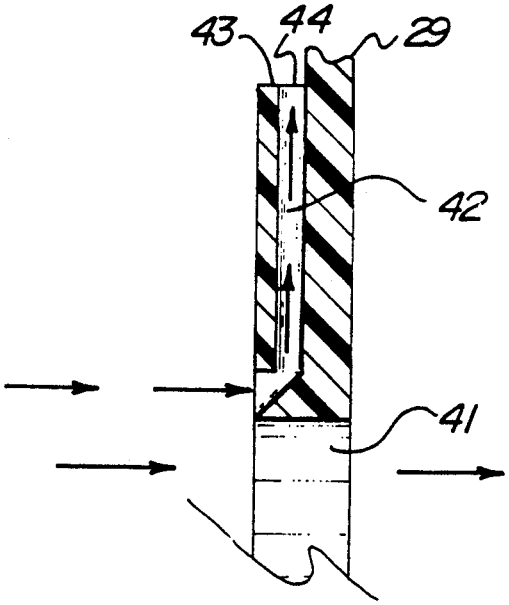
FIG. 8 is an orthographic view, taken along the lines 8—8 of FIG. 7 in the direction indicated by the arrows.

The FIG. 5 indicates the use of a modified bubble distribution member, wherein the first loop includes a multiapertured first disc 26 having a plurality of apertures therethrough. A support rod 29 is mounted to the first disc, with the support rod 29 having a handle shaft 30 thereon. The handle shaft is of a shaft length greater than a predetermined length to prevent total projection of the bubble distribution member through the associated slot 17. The handle plate 18 is indicated as a modified handle plate 28 in the organization of FIG. 5, having a handle plate first end wall 31 arranged for selective engagement with a handle plate second end wall 32. The first end wall 31 includes an L-shaped latch rod 33 spaced from an alignment lug 34 that are received into the second end wall 32. The second end wall includes second end wall cavity 35 having a latch rod receiving cavity 39 directed into the second end wall 32 in communication with the second end wall cavity 35. A button member 36 is slidably mounted within the second end wall cavity 35 and biased exteriorly of the handle plate 28 by a spring 38. Upon projection of the button member 36 within the second end wall cavity 35, a button member abutment lug 37 engages the L-shaped latch rod 33 to disengage the latch rod relative to a locking lug 33*a*. In this manner, the first end wall 31 is separated from the second end wall 32 to permit selective securement of a modified first loop 40 to the second end wall 35 by the latch mechanism, as indicated in FIG. 6. The modified first loop 40 includes a first loop central opening 41 oriented symmetrically about a predetermined axis, with a plurality of radial conduits 42 orthogonally oriented relative to the axis in communication with the central opening 41 and extending through the first loop 40, each having an exit port 44 directed through a first loop peripheral annular wall 43, as indicated in FIG. 8. In this manner, bubble members may be projected through the central opening 41, as well as from the exit ports 44 peripherally about the modified first loop 40.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A toy bubble kit, comprising, a container, the container including a container side wall and the side wall having a side wall upper distal end, and a container lid arranged for securement to the upper distal end, the lid including a lid top wall, and the lid top wall having a slot directed therethrough, the slot having a slot length equal to a predetermined length, and a bubble distribution member, with the bubble distribution member having a handle plate, the handle plate including a plate first end and a plate second end, the plate first end having a first loop, the plate second end having a second loop, the first loop having a first diameter less than the predetermined length, and the second loop having a second diameter less than the first diameter, and the slot includes a first resilient flap and a second resilient flap mounted within the slot, with the first resilient flap and the second resilient flap coextensive with the slot, and having an interface medially and longitudinally of the slot, and the first resilient flap includes a plurality of first digits, and the second resilient flap includes a plurality of second digits, and the interface is interdigited in registration of the first digits relative to the second digits at the interface of the first resilient flap and the second resilient flap, and the handle plate is separable and includes a first end wall arranged for engaging a second end wall, and the first loop, the second loop, and the handle plate are coplanar relative to one another, with the first end wall having an L-shaped latch rod, and an alignment lug spaced from the latch rod, and the second end wall includes a latch rod receiving cavity directed into the second end wall, and a second end wall cavity positioned within the handle plate in communication with the latch rod receiving cavity, and a button member reciprocatably mounted within the second end wall cavity, and having a spring positioned within the second end wall cavity biasing the button member, with the button member further including an abutment lug, the abutment lug arranged for engagement with the L-shaped latch rod when the L-shaped latch rod is directed within the latch rod receiving cavity to displace the latch rod relative to a locking lug positioned within the second end wall cavity for permitting separation of the first end wall relative to the second end wall.

2. A toy bubble kit as set forth in claim 1 wherein the first loop includes a central opening, the central opening symmetrically oriented about a predetermined axis, and a plurality of radial conduits in communication with the central opening, and the first loop having a first loop peripheral annular wall, and each of the radial conduits extend from the central opening to the peripheral annular wall, and each of the radial conduits terminates in an exit port.

3. A toy bubble kit as set forth in claim 1 wherein the first loop further includes a support rod colinearly aligned with the handle plate, the support rod having a handle shaft orthogonally mounted to the support rod spaced from the first loop, and the handle shaft having a shaft length greater than the predetermined length.

* * * * *